United States Patent [19]

Shaw et al.

[11] 4,137,516

[45] Jan. 30, 1979

[54] GRINDING WHEEL CRACK DETECTOR

[75] Inventors: Milton C. Shaw; Rangachary Komanduri, both of Pittsburgh, Pa.; Soichi Kumekawa, Higashimurayama, Japan

[73] Assignee: Carnegie-Mellon University, Pittsburgh, Pa.

[21] Appl. No.: 846,688

[22] Filed: Oct. 31, 1977

[51] Int. Cl.[2] ..... H01C 13/00

[52] U.S. Cl. ..... 338/67; 51/165 R; 51/206 R; 51/268; 338/292; 338/300; 338/311

[58] Field of Search ..... 338/67, 252, 258, 267, 338/285, 292, 296, 300, 311; 51/165 R, 134.5 R, 206, 268

[56] References Cited

U.S. PATENT DOCUMENTS

| | | | |
|---|---|---|---|
| 3,477,019 | 11/1969 | Hartmann | 324/52 |
| 3,724,138 | 4/1973 | Ishikawa | 51/165 R |

*Primary Examiner*—C. L. Albritton

*Attorney, Agent, or Firm*—Buell, Blenko & Ziesenheim

[57] ABSTRACT

A grinding wheel is provided around the inside of its hole with a plurality of turns of an electrical conductor weaker in tension than the material of the wheel, the ends of which are brought out to terminals on the surface of the wheel. Incipient cracks in the wheel rupture the conductor, which is checked as desired with a continuity testing device.

20 Claims, 8 Drawing Figures

$$\sigma_o = \frac{\gamma V^2}{4g}(3+\nu)$$

$\gamma$ = Specific Weight, lb./cu.in.

V = Surface Speed, ips $\nu$ = Poisson's Ratio g = Gravity = 389 in/s$^2$

GRINDING WHEEL CRACK DETECTOR

This invention relates to grinding wheels. It is more particularly concerned with means for detecting cracks in grinding wheels.

A significant industrial hazard is the bursting of grinding wheels during operation. Safety measures usually taken include the provision of wheel guards of various sorts, which, of course, seek to minimize damage after a break occurs, and inspection of wheels to detect cracks already formed before they reach dangerous proportions. No convenient means is available, as far as we know, to detect cracks which are not visible on the surface of a wheel and no means are available to detect cracks when the wheel is mounted on its arbor.

It is an object of our invention to provide means for detecting incipient cracks in grinding wheel whether or not they are visible on a surface of the wheel. It is another object to provide such means which operate when a wheel is mounted on its arbor. It is another object to provide such means, a portion of which are incorporated in the grinding wheel during manufacture. It is still another object to provide methods of incorporating such means in a grinding wheel. Other objects of our invention will appear in the course of the description thereof which follows.

Our invention comprises, briefly, providing in the bore of a grinding wheel a plurality of turns of an electrical conductor weaker in tension than the material of the wheel disposed over the surface of the bore, the ends of which conductor are brought out on the sides of the wheel. Testing is effected by connecting those ends to a continuity testing device, which may be simply a battery in series with a lamp. Incipient cracks in the wheel rupture the conductor, and so are detected before they can grow to critical size for spontaneous crack growth. It is thus possible to take a wheel from service before gross fracture occurs.

Embodiments of our invention presently preferred by us are illustrated in the attached figures, to which reference is now made.

Figure 4:
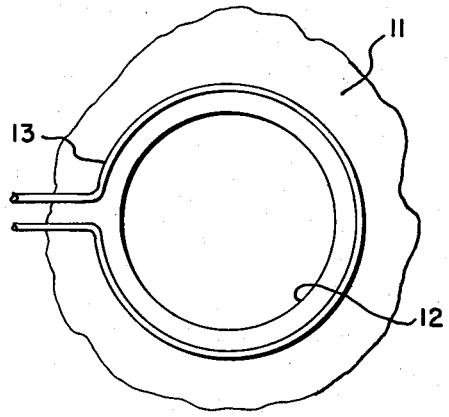
FIG. 4 is a side view of a portion of a grinding wheel provided with electrical conductor crack detecting means found by us to be unsatisfactory.

Understanding of our invention will be facilitated by reference to FIG. 4, which represents our first attempt to achieve the objectives above set out. A grinding wheel 11 having a bore 12 is provided with a loop 13 of an electrical conductor positioned annularly around bore 12 on one face of the wheel. The ends of the loop are lead out so that they can be conducted to a continuity testing device. The conductor loop 13 was 40 gauge copper wire, of approximately 0.003 inch diameter. The apparatus was tested by spinning the grinding wheel on its arbor at speeds above its safe value and making continuity tests. As long as loop 13 was unbroken, the continuity device indicated continuity. This method failed to indicated the presence of a crack before spontaneous crack growth occurred and hence does not represent a suitable sub critical crack detection technique.

Figure 1:
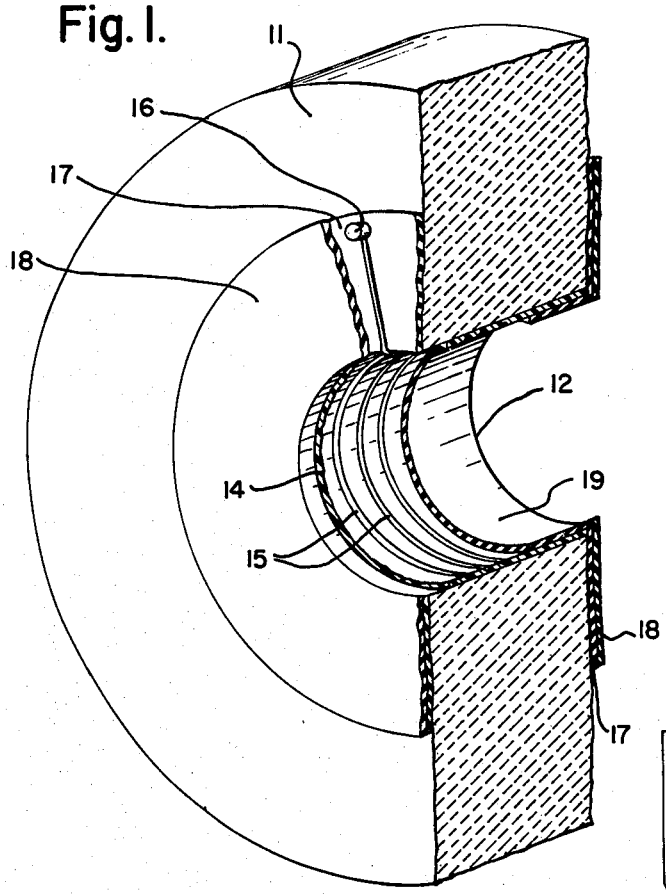
FIG. 1 is a view of a grinding wheel broken away to show apparatus of our invention.
Figure 2:
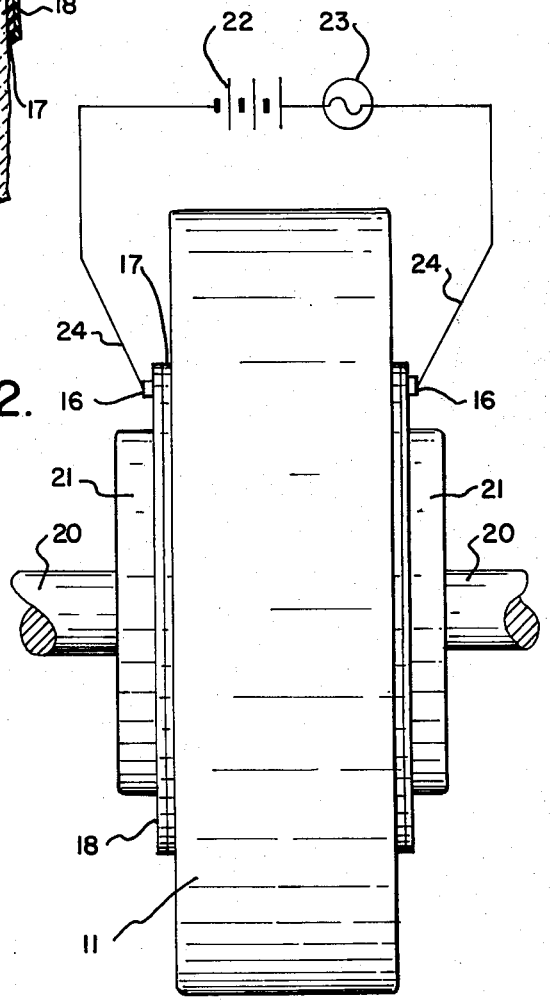
FIG. 2 is a front elevation of the grinding wheel of FIG. 1 mounted on an arbor, together with a diagrammatic representation of continuity testing means connected thereto.

One embodiment of modified apparatus which successfully detects cracks before wheel failure is illustrated in FIGS. 1 and 2. The surface of bore 12 is impregnated with a thin layer of epoxy resin 14. In this surface is cut a thin helical groove, preferably of small pitch, which is filled with electrically conducting silver paint to form a helix of conducting turns 15, the ends of which are brought out on opposite sides of wheel 11 to terminals 16. Each terminal 16 is affixed to an annulus of insulating material 17 applied against the side of the wheel. Annulus 17 in turn is covered by a second annulus of insulating material 18, between which annuli the end of conductor 15 passes to terminal 16. The turns 15 on the surface of resin 14 are covered by an insulating layer 19.

As is shown in FIG. 2, the wheel 11 is mounted on an arbor 20 between the usual flanges 21. The continuity determining means comprise a battery 22 connected in series with a lamp 23. The free terminals are connected to probes 24 which are touched to contacts 16 on the wheel.

We have found that the silver conducting paint film ruptures before an incipient grinding wheel crack can propagate to destruction of the wheel. The film is weak in tension relative to the material of the wheel it self and is weaker than 40 gauge copper wire. By spacing turns of conductor 15 over the surface of the wheel bore, cracks extending from any region of the bore are detected when they form.

Figure 3:
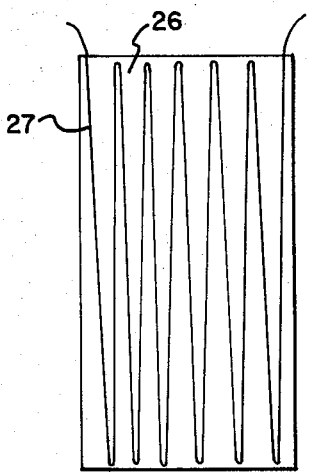
FIG. 3 is a developed view of a portion of another embodiment of our invention.

It is not essential that the turns 15 of the conductor form a helix, or that they be applied to the wheel bore in place. FIG. 3 illustrates the essential feature of another embodiment of our invention. A rectangular film 26 of flexible material having one dimension equal to the length of bore of a wheel and the other equal to the circumference of the bore is provided with conductor 27 applied to it in zigzag pattern as shown. The film is then curled into a cylinder and cemented to the surface of the bore 12 with the ends of the conductor brought out to terminals 16 as before.

The supporting film must be weak in tension relative to the grinding wheel material. As has been mentioned, the film can be a resin, or it may be sulfur, pure or impregnated with a non-conducting strengthening agent, other brittle non-conducting material such as dental plaster, or similar material. It may also be formed using aluminum foil as starting material. After the turns of the conductor have been applied thereto, and the film cemented in the bore, as described in connection with FIG. 3, or otherwise, the film is sprayed with glass frit and heated to convert the aluminum to a brittle ceramic $Al_2O_3$—$SiO_2$ compound. The conductor in such case must be stable enough to withstand the firing. Another method of fabrication employs a pliable paper film as substrate. After the conductor has been applied, the paper is impregnated with an embrittling agent, such as water glass.

Our preferred conductor material is silver conducting paint, and turns of this material are readily printed on the substrate films above mentioned. Alternatively after a helical groove has been cut in the support film, the entire surface of the film is coated with silver paint or other conducting material and the paint is then removed between the grooves so as to provide a thin electrically conducting path.

Figure 5:
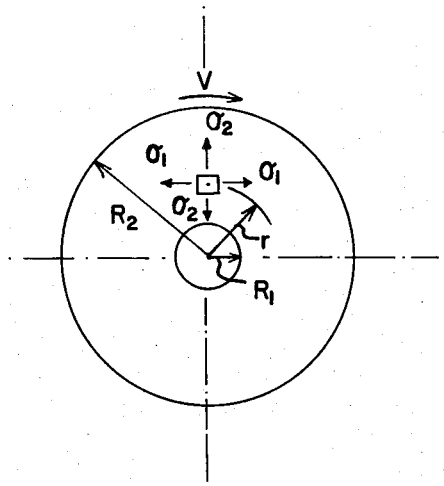
FIG. 5 is a plot of stress relations at various locations within a grinding wheel.
Figure 5:
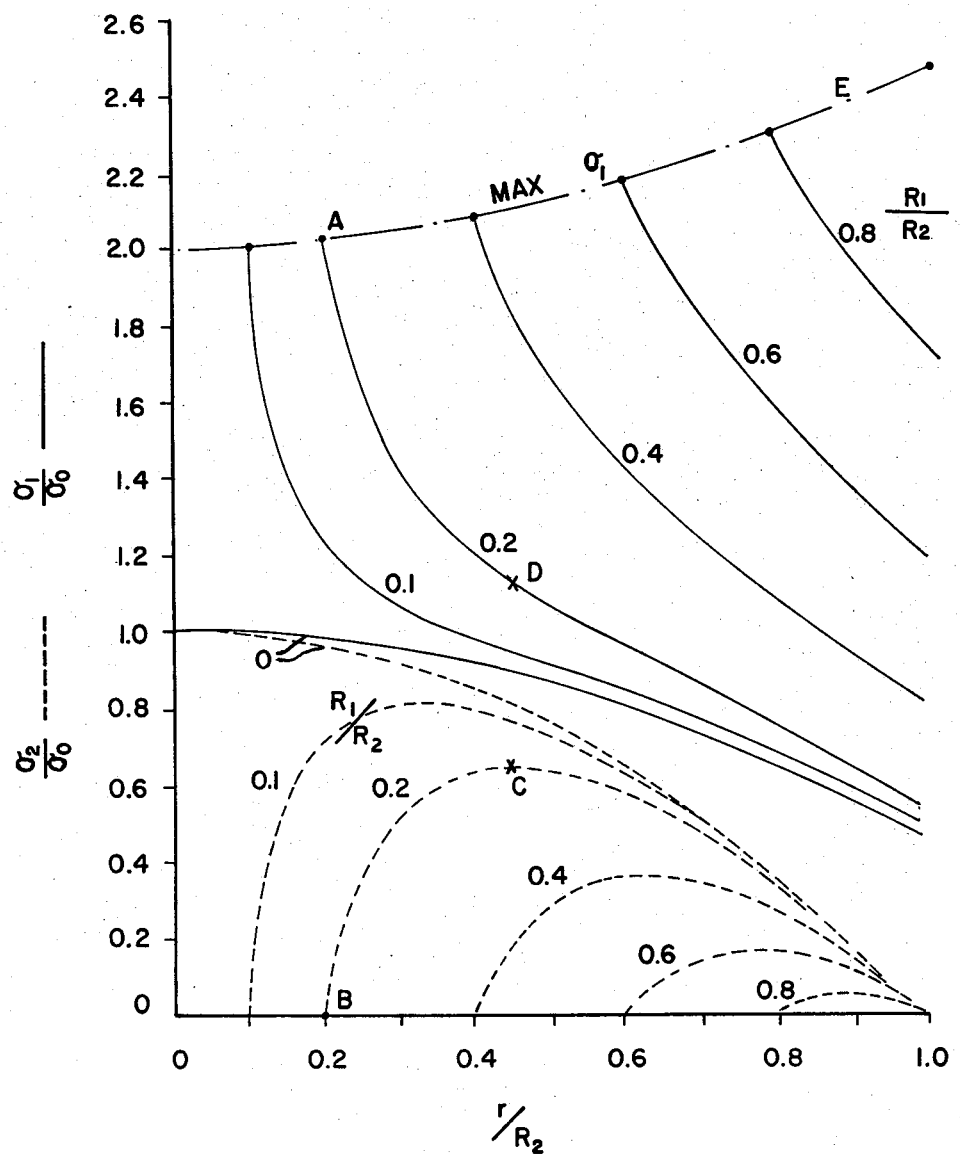

While we have described continuity determing means which are applied to a wheel only when it is at rest, contacts 16 can be formed as slip rings and the continuity determining means can be connected thereto through sliding contacts to check continuity continuously during operation of the wheel It can be shown analytically that a crack which forms at the bore of a spinning grinding wheel can be detected before it reaches a critical size at which spontaneous generation begins. For this purpose the following symbols are used:

$R_1$ = radius of bore of grinding wheel
$R_2$ = radius of grinding wheel
r = radius of any point in wheel
$\sigma 1$ = tangential stress at any point r
$\sigma 2$ = radial stress at any point r
$\sigma 3$ = axial stress at any point, = 0
$\sigma e$ = effective fracture strength
$\sigma H$ = mean principal stress = $\sigma_1 + \sigma_2 + \sigma_3/3$ Stress $\sigma_1$ and $\sigma_2$ are calculated herein and plotted in FIG. 5 relative to $\sigma_0 = (\delta V^2/4g)(3 + \nu)$ Where $\delta$ = specific weight of the wheel material in pounds per cubic inch,
V = surface speed, in inches per second
$\nu$ = Poisson's ratio
g = acceleration of gravity, (389 inches per sec.$^2$)

General expressions for $\sigma_1$ and $\sigma_2$ follow.

$$\sigma_1 = \frac{\sigma_0}{2}(3 + \nu)\left[1 + \frac{R_1^2}{R_2} + \frac{R_1^2}{r}\right] - \frac{r^2}{R_2}(1 + 3\nu)$$

$$\sigma_2 = \frac{\sigma_0}{2}\left[(3 + \nu)\left[1 + \frac{R_1^2}{R_2} + \frac{R_1^2}{r}\right]\right]$$

For example, a grinding wheel having an outside diameter of 10 inches and a bore diameter of 2 inches will be one for which $r_1/R_2 = 0.2$, and stress $\sigma_1$ will be a maximum at the bore and equal to:

$$\sigma_1 = 2.02\ \sigma_0 \text{ (point A in FIG. 5)}$$

The corresponding maximum value of $\sigma_2$ will be zero (point B).

Brittle materials such as grinding wheels fracture in accordance with a maximum tensile strain criterion where the tensile strain at fracture is a function of the mean principal stress at the point in question ["Brittle Fracture Under Biaxial Normal Stress", M. C. Shaw and R. Komanduri, Fracture 1977 (Proc. of Fourth International Fracture Conference) Waterloo University, Waterloo Ontario, Canada. 3, 949, (1977)]. The effective fracture stress ($\sigma_e$) is defined as Young's Modulus times the strain at fracture, or $$\sigma_e = \sigma_1 - \nu(\sigma_2 + \sigma_3)$$

where $\sigma_1$, $\sigma_2$, and $\sigma_3$ are the principal stresses at the point of fracture and $\nu$ is Poisson's ratio. Stress $\sigma_e$ is rather strongly influenced by the mean principal stress $$\sigma_H = (\sigma_1 + \sigma_2 + \sigma_3)/3$$

The effective fracture stress ($\sigma_e$) increases as $\sigma_H$ becomes more compressive (negative) and vice versa. For a 6% cobalt sintered tungsten carbide, $$\Delta\sigma e/\Delta\sigma H \approx 1.2$$

while for a 12% cobalt material this ratio is about 1/4. For a relatively brittle vitrified grinding wheel $\Delta\sigma e/\Delta\sigma H$ is estimated to be about 2.

From FIG. 5 it is evident that at the bore, $$\sigma_e = \sigma_1 = 2.02\ \sigma o$$

for the example under consideration and that, $$\sigma_H = \sigma_1/3 = (2.02/3)\ \sigma_0 = 0.67\ \sigma_0$$

There will be less tendency for a crack to initiate internally in the wheel than at the surface of the bore. As we progress radially inward from the bore, stress $\sigma_1$ is seen to decrease rather rapidly but $\sigma_2$ at first increases and then decreases. Let us consider the situation at the point in the wheel of the above example where $\sigma_2$ is a maximum (point C in FIG. 5). It may be shown that stress $\sigma_2$ is a maximum when, $$r/R_2 = \sqrt{R_1/R_2}$$

and for the example considered above this gives $r/R_2 = \sqrt{0.2} = 0.45$. The following values pertain for this point if $\nu = 0.25$.

$$\sigma_1 = 1.14\ \sigma_0 \text{ (point D)}$$

$$\sigma_2 = 0.64\ \sigma_0 \text{ (point C)}$$

$$\sigma_e = [1.14 - (0.64)\ 0.25)]\ \sigma_0 - 0.98\ \sigma_0$$

$$\sigma_H = \frac{(1.14 + .64)}{3}\ \sigma_0 = .59\sigma_o$$

It is thus seen that the point corresponding to C and D is subjected to a lower mean tensile stress ($\sigma_H$) than a point at the bore. This tends to increase the fracture stress at this point relative to that at the bore. At the same time $\sigma_e$ at the internal point is about half of that at the bore. Therefore, there is a rather strong tendency for a crack to initiate at the bore, rather than at an internal point in the wheel.

The values of stress shown in FIG. 5 do not take into account values of stress concentration that will always be present. In fact, due to the porous structure of a grinding wheel it will have a mean natural stress concentration ($K_o$) associated with it that depends upon the mean pore size (a function of grain size, bond type and amount and wheel homogeneity). If any point on the bore has a stress concentration factor ($K_a$) greater than $K_o$ the first crack should appear at this point. However, as the crack begins to grow the value of K will drop to $K_o$ if fracture occurs along the bond bridges which hold the wheel together. The effective stress $\sigma_1$, at the bore will rise rather slowly along line AE as the crack grows. As long as the difference between $K_a$ and $K_0$ is less than the increase in $\sigma_1$ due to crack growth indicated by the slope of line AE, the crack will grow slowly at first before it reaches the critical size to cause spontaneous crack growth.

In some instances the difference between $K_a$ and $K_o$ may not be sufficient to result in slow initial crack growth which is important to the monitoring technique described here. In such cases it is possible to provide an artificially induced stress concentration at the bore in the form of a controlled scratch or by use of a different grain size at the bore that will make it necessary for the initial crack to grow slowly at the outset so that it may be detected. A larger grain size tends to increase stress concentration. The voids between the grains tend to have sharper corners, which act as stress raisers. If such a controlled stress concentration proves necessary the important consideration is that the stress concentration induced be greater than the "natural" value due to porosity ($K_0$), by an amount exceeding the rise associated with curve AE as the crack grows.

Figure 7:
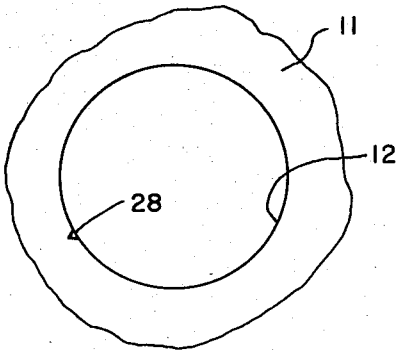
FIG. 7 is an elevation of a portion of the wheel material only of FIG. 6 showing the axial scratch in elevation.
Figure 6:
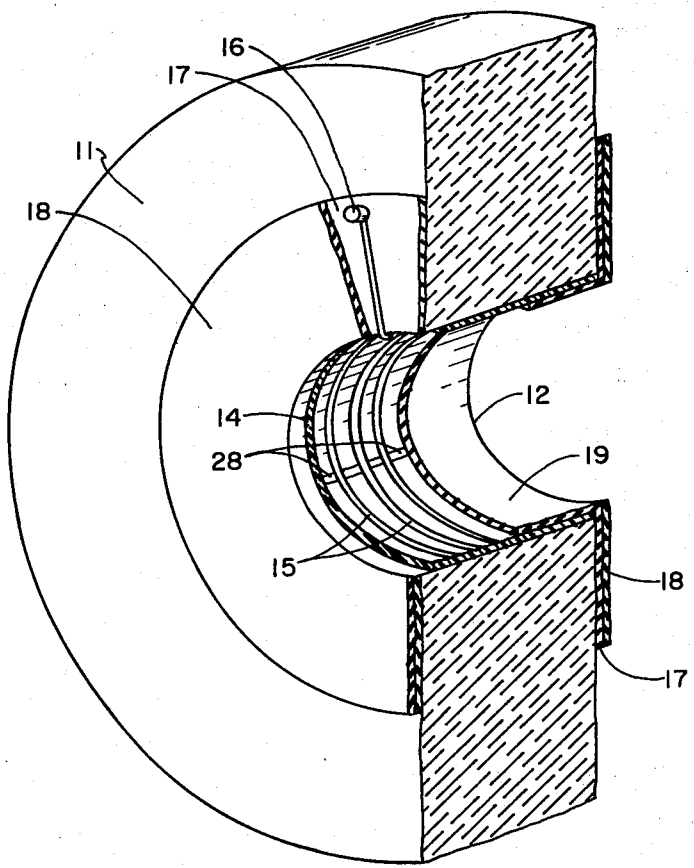
FIG. 6 is a view similar to FIG. 1 showing a grinding wheel according to our invention with a deliberately provided axial scratch along its bore.

FIGS. 6 and 7 illustrate a grinding wheel according to our invention provided with an artifically created scratch in its bore to concentrate stress thereat. The parts identical with those of FIG. 1 carry the same reference characters. In bore 12 is provided a V-shaped scratch 28. Stresses tending to rupture the wheel are greater in the region of the scratch 28 than elsewhere in the wheel.

Figure 8:
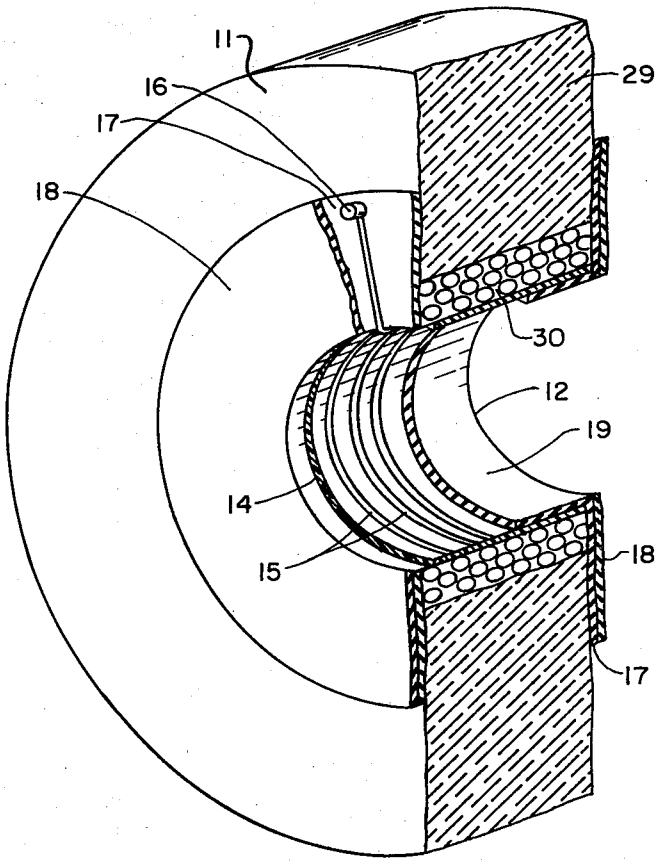
FIG. 8 is a view similar to that of FIG. 1 showing a grinding wheel according to our invention with differential grain size.

FIG. 8 illustrates a grinding wheel according to our invention having a larger grain size in the bore region than in the remainder of the wheel. Again the parts identical with those of FIG. 1 carry the same reference characters. The bulk of the wheel 11 is of relatively small grain composition 29. The region around bore 12, however, is composed of larger grain material 30.

Another important question is whether the first crack will tend to form at a point (1) on the bore adjacent a side of the wheel, where plane stress pertains, or on the bore at an inside point (2), where plane strain pertains. For the plane stress situation when $R_1/R_2 = 0.2$.

$$\sigma_1 = 2.02\ \sigma_0$$

$$\sigma_2 = \sigma_3 = 0$$

$$\sigma_e = 2.02\ \sigma_0$$

$$\sigma_H = (2.02/3)\ \sigma_0 = 0.67\ \sigma_0$$

For the plane strain situation, $$\sigma_3 = (1/E)\ (\sigma_3 - \nu\ [\sigma_2 + \sigma_1]) = 0$$

or $$\sigma_3 = \nu(\sigma_2 + \sigma_1) = (\sigma_2 + \sigma_1)/4$$

and hence, $$\sigma_1 = 2.02\ \sigma_0 \text{ (point A for } R_1/R_2 = 2)$$

$$\sigma_2 = 0$$

$$\sigma_3 = (2.02/4)\ \sigma_0 = 0.505\ \sigma_0$$

Therefore, for point (2) where plane strain pertains:

$$\sigma_e = 2.02\ \sigma_0 - \frac{.505}{4}\ \sigma_0 = 1.89\sigma_0$$

-continued $$\sigma_H = \frac{2.02\ \sigma_0 + .505\ \sigma_0}{3} = 0.842\sigma_0$$

It is thus evident that at point (2) the stress is lower but the value of $\sigma_H$ is more tensile. To estimate the net effect of these two opposing tendencies it is useful to estimate the equivalent value of $\sigma_e$ at point (2) when $\sigma_H$ has the same value at this point as that at point (1). The value $\Delta\sigma_H$ between points (2) and (1) is (0.842 − 0.670) $\sigma_0$ = 0.344 $\sigma_0$. If $\Delta\sigma_e/\Delta\sigma_H = 2$ for a vitrified wheel $\Delta\sigma_e$ will be 0.344 $\sigma_0$ and hence the equivalent value of $\sigma_e$ at point (2) will be 1.89 $\sigma_0$ = 0.344 $\sigma_0$ = 2.234$\sigma_0$. Comparing this with $\sigma_e$ at point (1) (=2.02 $\sigma_0$), it is expected that fracture will occur first at point (2) (plane strain) rather than at point (1) (plane stress).

In the foregoing specification we have described presently preferred embodiments of our invention, however, it will be understood that our invention can be otherwise embodied within the scope of the following claims.

We claim:

1. The combination of a grinding wheel and crack detecting means therefore, those means comprising a film of electrically insulating material affixed to the surface of the bore in the grinding wheel, a coil of an electrical conductor disposed on the film so as to form a plurality of turns around the grinding wheel bore, and contact means for each end of the coil affixed to the grinding wheel and adapted for connection with external continuity determining means, the film and the conductor being weak in tension relative to the grinding wheel, so that inception of a crack in the grinding wheel ruptures the conductor.

2. The combination of claim 1 in which the film is a resin adhered to the grinding wheel.

3. The combination of claim 1 in which the resin is an epoxy resin.

4. The combination of claim 1 in which the film is a ceramic.

5. The combination of claim 1 in which the film is dental plaster.

6. The combination of claim 1 in which the film comprises sulfur.

7. The combination of claim 1 in which the conductor is silver conducting paint film.

8. The combination of claim 1 in which the insulating film covers the surface of the bore in the grinding wheel.

9. The combination of claim 8 in which the turns of the conducting coil are disposed over the surface of the insulating film.

10. The combination of claim 1 in which the contact means for each end of the coil are affixed to opposite faces of the grinding wheel.

11. The combination of claim 1 in which the coil of the electrical conductor is a helix.

12. The combination of claim 1 in which the conductor has a tensile strength less than 40 gauge copper wire.

13. The combination of claim 1 in which the grinding wheel is provided with means for raising stress consentration around its bore so as to delay spontaneous propagation of a crack there formed.

14. The combination of claim 13 in which the means for raising stress concentration comprise a scratch on the surface of the bore longitudinally thereof.

15. The combination of claim 13 in which the means for raising concentration comprise a region adjacent the bore of the grinding wheel having a grain size greater than the grain size of the remainder of the wheel.

16. The method of affixing a film of insulating material weak in tension carrying a coil of an electrical conductor weak in tension to the surface of the bore in a grinding wheel comprising impregnating the surface of the bore with a layer of a plastic material weak in tension, cutting a helical groove in that layer, and filling the groove with electrically conducting paint.

17. The method of claim 16 in which the groove is filled with electrically conducting paint by coating the layer with electrically conducting paint and then removing the paint between the grooves so as to leave an electrical conducting path.

18. The method of affixing a film of insulating material weak in tension carrying a coil of an electrical conductor weak in tension to the surface of the bore in a grinding wheel comprising cementing a flat coil of the conductor to aluminum foil, cementing the foil and coil around the surface of the bore in the wheel, spraying the aluminum foil with glass frit, and then heating it to convert the aluminum foil to a brittle $Al_2O_3$—$SiO_2$ compound.

19. The method of affixing a film of insulating material weak in tension carrying a coil of an electrical conductor weak in tension to the surface of the bore in a grinding wheel comprising cementing a flat coil of the conductor to a pliable organic substrate, cementing the substrate and coil around the surface of the bore in the wheel and impregnating the organic substrate with an embrittling substance.

20. The method of claim 19 in which the substrate is paper and the embrittling substance is water glass.

* * * * *

UNITED STATES PATENT AND TRADEMARK OFFICE

CERTIFICATE OF CORRECTION

PATENT NO. : 4,137,516

DATED : January 30, 1979

INVENTOR(S) : Milton C. Shaw, Rangachary Komanduri and Soichi Kumekawa

It is certified that error appears in the above-identified patent and that said Letters Patent are hereby corrected as shown below:

Column 3, line 11, "determing" should read --determining--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,137,516
DATED : January 30, 1979
INVENTOR(S) : Milton C. Shaw, Rangachary Komanduri and Soichi Kumekawa It is certified that error appears in the above-identified patent and that said Letters Patent are hereby corrected as shown below:

Column 6, line 14, "= 0.344" should read -- + 0.344 --.

THIS CERTIFICATE SUPERSEDES CERTIFICATE OF CORRECTION ISSUED May 15, 1979.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*